US007984967B2

(12) United States Patent
Ikegame et al.

(10) Patent No.: US 7,984,967 B2
(45) Date of Patent: Jul. 26, 2011

(54) INK JET HEAD

(75) Inventors: Ken Ikegame, Atsugi (JP); Keiichiro Tsukuda, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 740 days.

(21) Appl. No.: 12/098,850

(22) Filed: Apr. 7, 2008

(65) Prior Publication Data

US 2008/0259119 A1 Oct. 23, 2008

(30) Foreign Application Priority Data

Apr. 13, 2007 (JP) ..... 2007-105901
Apr. 1, 2008 (JP) ..... 2008-095124

(51) Int. Cl.
*B41J 2/14* (2006.01)

(52) U.S. Cl. ..... 347/47; 347/40

(58) Field of Classification Search ..... 347/40, 347/47

See application file for complete search history.

(56) References Cited

U.S. PATENT DOCUMENTS

| | | | | |
|---|---|---|---|---|
| 5,508,725 | A * | 4/1996 | Goto et al. | 347/65 |
| 5,682,190 | A * | 10/1997 | Hirosawa et al. | 347/94 |
| 6,030,065 | A * | 2/2000 | Fukuhata | 347/15 |
| 6,592,202 | B2 * | 7/2003 | Udagawa et al. | 347/40 |
| 6,637,874 | B2 * | 10/2003 | Yazawa et al. | 347/86 |
| 6,830,317 | B2 * | 12/2004 | Tsuchii et al. | 347/56 |
| 6,964,467 | B2 * | 11/2005 | Kaneko et al. | 347/40 |
| 7,175,255 | B2 * | 2/2007 | Okito et al. | 347/40 |
| 7,249,815 | B2 * | 7/2007 | Keller et al. | 347/9 |
| 7,384,129 | B2 * | 6/2008 | Nagata et al. | 347/43 |
| 7,874,639 | B2 * | 1/2011 | Nagata et al. | 347/43 |
| 2004/0021731 | A1 * | 2/2004 | Yabe et al. | 347/40 |
| 2007/0242108 | A1 * | 10/2007 | Inoue | 347/65 |

FOREIGN PATENT DOCUMENTS

| | | |
|---|---|---|
| JP | 10-166576 | 6/1998 |
| JP | 11-348316 | 12/1999 |
| JP | 2003-266720 | 9/2003 |
| JP | 2004-148746 | 5/2004 |
| JP | 2007-283501 | 11/2007 |
| RU | 2 170 675 | 7/2001 |

* cited by examiner

*Primary Examiner* — Charlie Peng
(74) *Attorney, Agent, or Firm* — Fitzpatrick, Cella, Harper & Scinto

(57) ABSTRACT

An ink jet head includes an elongated ink supply port extending in a longitudinal direction and a plurality of head groups arranged in a transverse direction crossing with the longitudinal direction. A first array of ink ejection outlets is disposed along one lateral side of an ink supply port, and second and third arrays of ink ejection outlets are disposed along the other lateral side of the ink supply port, wherein widths L2, measured in the longitudinal direction, of partition walls for the first array of the ink ejection outlets are larger than widths L1, measured in the longitudinal direction, of partition walls of the second and third arrays of the ink ejection outlets. The ink jet head further includes a sealing tape for protecting the ejection outlets, the sealing tape being peelable in a direction from the second or third array toward the first array.

8 Claims, 6 Drawing Sheets

(a)

(b)

INK JET HEAD

FIELD OF THE INVENTION AND RELATED ART

The present invention relates to an ink jet head, to which a seal tape for protecting the surface of the ink jet head (which is hereafter will be referred to as "ink jetting surface" or "ink ejection surface", at which the outward end of each of the ink jetting nozzles of the ink jet head opens, is bonded. More specifically, it relates to an ink jet head structured so that the sealing tape adhered to the ink jet head to protect the ink jetting nozzles of the ink jet head during the shipment of the ink jet head, can be peeled without damaging the "ink ejection surface."

The present invention is applicable to an ink jet head that records an image on recording medium, such as a piece of paper, thread, fiber, fabric, leather, metal, plastic, glass, lumber, ceramic, etc. An ink jet head to which the present invention is applicable is used by an apparatus, such as a printer, a copying machine, a facsimile apparatus with a communication system, a word processor with a printing portion, and the like. The present invention is also applicable to an ink jet head that is used by a commercial recording apparatus, or the like, which is integral with various processing apparatuses. Incidentally, a term "recording" in the following description of the present invention means a process of forming not only an image, such as a letter, a specific pattern, etc., which has a meaning, but also, a meaningless pattern, on recording medium.

An ink jet head to be mounted in an ink jet recording apparatus is capped before it is shipped from its factory. More specifically, before an ink jet head is shipped from its factory, it is capped across its ink ejection surface to protect the surface from external impact or the like, during the shipment of the ink jet head. Further, an ink jet cartridge, that is, a cartridge made up of an ink jet head and an ink container, is structured so that the ink ejection surface of its ink jet portion can be capped or covered with a sealing tape (which hereafter may be referred to as protection tape or protection seal) to protect the surface from external impacts, or to prevent ink from evaporating, during the shipment of the ink jet cartridge.

As an example of ink jet head structure in accordance with the prior art, the ink jet head structure disclosed in Japanese Laid-open Patent Application H11-348315 has been known. In the case of this ink jet head structure, a head protection tape with adhesive or thermoplastic resin is used as its head protection tape. More specifically, the protection tape is provided with adhesive or thermoplastic resin applied on the surface, along the edges of the surface, by which they are bonded to the ink jet head. The protection tape is bonded to the ink ejection surface, or the edges of the ink ejection surface, of the ink jet head, to keep the ink ejection nozzles (surface) protected and/or sealed.

It is possible that when a sealing tape is removed from an ink jet head, the ink jet head will be damaged by the removal of the sealing tape, because of the strong bond between the sealing tape and the ink ejection surface of the ink jet head. Thus, Japanese Laid-open Patent Applications 2003-266720 and 2004-148746 disclose an ink jet head and a seal tape, which were designed to minimize the area of the seal tape, to which adhesive must be applied to keep the seal tape bonded to the ink jet head to protect the ink jet head, in particular, its ink ejection surface.

More specifically, the area of the protection tape, which directly faces the ink ejection surface of the ink jet head, is not coated with adhesive, or is coated with protective liquid. That is, the adhesive is applied only across the area of the protective tape, which does not directly face the ink ejection surface of the ink jet head.

A combination of an ink jet head and a seal tape, which is designed as described above, can prevent the solvent of the ink from evaporating during the shipment of the ink jet head. It also can prevent the ink ejection surface of the ink jet head from coming into contact with objects other than the seal tape, preventing thereby the ink ejection surface from being subjected to external impacts. Further, in the case of this combination, the seal tape (protection tape) is not bonded to the ink ejection surface. Therefore, when the protection tape (seal tape) is peeled from the head, the ink ejection surface is not subjected to any force, being therefore prevented from being damaged by the peeling of the protection tape. Thus, the ink jet head can satisfactorily record an image after being mounted in a printer.

There have been known many other examples of an ink jet head, to which a seal tape (protection) tape is pasted on the ink ejection surface before they are shipped, for example, the ink jet heads structured as disclosed in Japanese Laid-open Patent Applications H11-348316, 2003-266720, and 2004-148746, and the ink jet heads structured as disclosed in Japanese Laid-open Patent Applications H10-166576, and 2007-283501.

In the case of the ink jet head disclosed in Japanese Laid-open Patent Application H10-166576, it is provided with nozzles with a smaller diameter and nozzles with a larger diameter to enable the ink jet head to change the size in which ink droplets are ejected from the ink jet head. More specifically, the ink jet head is provided with two head elements, that is, a head element made up of a column of large diameter nozzles and a head element made up of a column of small diameter nozzles and the two head elements are juxtaposed in parallel (FIG. 2 in Japanese Laid-open Patent Application H10-166576). In the case of another ink jet head disclosed in Japanese Laid-open Patent Application H10-166576, it is also provided with multiple head elements. In the case of this ink jet head, however, each head element is made up of a column of large diameter nozzles and a column of small diameter nozzles, and the multiple head elements are juxtaposed so that all the head elements become the same in the order in which the column of large diameter nozzles and the column of small diameter nozzles are positioned in terms of the direction perpendicular to the columns of nozzles (FIGS. 7 and 8 in Japanese Laid-open Patent Application H10-166576).

In the case of the ink jet head disclosed in Japanese Laid-open Patent Application 2007-283501, it is provided with an ink delivery channel (common liquid chamber) which guides the ink supplied from an ink supply source, to the ink ejecting portion. In this case, a head element made up of a column of large diameter nozzles and a column of small diameter nozzles is positioned on one side of the common ink delivery channel, and another head element which is also made of a column of large diameter nozzles and a column of small diameter nozzles is positioned on the other one side of the common ink delivery channel. In this case, however, in consideration of recording characteristics of the ink jet head, the two head elements are made different in the order in which the column of large diameter nozzles and the column of small diameter nozzles are positioned in each head element, in terms of the direction perpendicular to the columns of nozzles (FIGS. 8 and 9 in Japanese Laid-open Patent Application 2007-283501). Also disclosed in this patent application is a technology to deal with the external pressure to which an ink jet head is subjected. More specifically, the ink jet head disclosed in this application is structured to deal with the problem that a nozzle plate is damaged by the external stress (which is caused by pressure which applies to ink jet head when ink jet head is cleaned to restore printer in printing characteristics, and/or as paper jam or the like occurs). In this case, the ink jet head is provided with reinforcement ribs, which are placed where the columns of large diameter nozzles are present.

In recent years, demand has become extremely high for an ink jet printer capable of forming an image which is substantially more precise than the image formable by a printer in accordance with the prior art. Thus, a liquid ejecting (jetting) head for an ink jet printer has come to be manufactured using the following steps. That is, first, a preset number of liquid ejection energy generating elements, such as a heater or a piezoelectric element, are formed on a substrate. Then, a layer of resin film is formed on the substrate in a manner to cover the energy generating elements. Then, a preset number of ink passages which correspond in position to the preset number of liquid ejection energy generating elements, are formed in the layer of resin film. Thereafter, a preset number of holes (liquid ejection nozzles) are formed in the layer of resin film to connect the outside of the layer of resin film and the ink passages. In the case of this method for manufacturing an ink jet head, the distance between the heater and liquid (ink) ejection hole can be set by controlling the thickness of the layer of resin film. Thus, this ink jet head manufacturing method is very desirable as a manufacturing method for a high precision recording head, that is, an ink jet head which jets (ejects) ink in the form of a microscopic droplet.

In order to deal with the demand for an ink jet printer capable of forming an image substantially more precise than the image formable by a printer in accordance with the prior art, an ink jet head has been increased in resolution by increasing the number of nozzles per unit length of the column in which the nozzles are aligned (dpi), and/or providing it with multiple columns of nozzles, some of which are placed on one side of the aforementioned common ink delivery channel, and the other of which are placed on the other side of the common ink delivery channel.

In the case of some ink jet recording heads which use a combination of the abovementioned methods for increasing an ink jet head in resolution, they are provided with a column of ink ejection nozzles which eject ink by 5 pl per ejection, a column of ink ejection nozzles which eject ink by 2 pl per ejection, and a column of ink jet nozzles which eject ink by 1 pl per ejection. Further, the first column of ink ejection nozzles is placed on one side of the common ink delivery channel, whereas the second third columns of ink ejection nozzles are placed on the other side of the common ink delivery channel. If these ink jet recording heads are structured so that their multiple columns of 5 pl, 2 pl, and 1 pl ink ejection nozzles are all 600 dpi ink ejection nozzle density, the ink ejection nozzle density in terms of the direction parallel to the columns of nozzles is 600 dpi on the side where the column of 5 pl nozzles is present is 600 dpi, and 12,00 dpi on the side where the columns of 2 pl and 1 pl nozzles are present. That is, in practical terms, the two sides are different in ink ejection nozzle density. In the case of these ink jet heads, the distance between the adjacent two ink ejection nozzles are significantly narrower than the distance between the adjacent two ink ejection nozzles in an ink jet head structured otherwise. Thus, the wall between the adjacent two ink passages is thinner, and therefore, the area of contact between the ink passage wall and substrate is smaller. Further, there are the ink passage and the space for heaters, on the inward side of the ink ejection nozzle. Therefore, the portion of the layer of resin, which is the adjacencies of the ink ejection nozzle, is weak against external force. There are cases where an ink jet head cannot be provided with the abovementioned reinforcement ribs. For example, in the case of the ink jet head disclosed in Japanese Laid-open Patent Application 2007-283501, the reinforcement ribs cannot be placed across the portion where the ink ejection nozzles are aligned at 1,200 dpi. When a protection tape similar to a protection tape pasted to an ink jet head in accordance with the prior art was pasted to an ink ejection nozzle plate (which hereafter will be referred simply as nozzle plate), it was possible that the nozzle plate would crack, and/or the ink passage walls would separate from the substrate, in the adjacencies of the ink ejection nozzle, because of the relationship between the direction in which the protection tape was pulled to peel the tape, and the amount of force applied to peel the tape.

Next, where and how the ink passage wall separates from the substrate will be described.

FIG. 7(*a*) is an enlarged schematic sectional view of the adjacencies of a pair of ink ejection nozzles of the ink jet head on which a seal tape 103, which was pasted across the ink ejection surface 119 of the ink jet head, remains intact. The seal tape 103 is made up of a substrate 101 and a layer 102 of adhesive. The substrate 112 of the ink jet head is provided with a common ink delivery channel 111 which delivers ink to the pair of ink ejection nozzles 115 and 116, of which an ink ejection (jetting) portion is made up. The common ink delivery channel is rectangular in the cross section perpendicular to the substrate 112. The ink jet head is provided with multiple ejection energy generating elements (which may be referred to as heaters), such as a pair of ejection energy generating elements 113 and 114, shown in FIG. 7(*a*), which are positioned on the substrate 112 in a manner to oppose the ink ejection nozzles 115 and 116, respectively. The ink jet head is also provided with a nozzle plate 120, which is bonded to the substrate 112. The nozzle plate 120 has ink passage walls, such as the ink passage walls 117 and 118, shown in FIG. 7(*a*), which partition an ink passage from the next ink passage. Each ink passage connects the common ink delivery channel 111 to an ink ejection nozzle (115, 116). The ink ejection nozzles (115) are arranged in a straight line parallel to the common ink delivery channel 111, with preset intervals (which hereafter will be referred to as pitch), on one side of the common ink delivery channel 111, whereas the ink ejection nozzles (116) are arranged in a straight line parallel to the common ink delivery channel 111, on the other side of the common ink delivery channel 111.

Referring to FIG. 7(*b*), as the seal tape 103 is peeled from the ink jet head in the direction indicated by an arrow mark 121, the nozzle plate 120 is subjected to the stress generated in the direction to peel the nozzle plate 120 from the substrate 112. The broken lines 122 in the drawing show the shape into which the nozzle plate 120 might be formed by the stress. If the peeling of the seal tape 103 is continued while the seal tape 102 is in the shape indicated by the broken lines 122, the stress is concentrated to the area of contact between the substrate 112 and the edge of the ink passage wall 117. Thus, if the bond between the seal tape 103 and ink ejection surface 119 is strong, it is possible that the ink passage wall 117 will be separated from the substrate 112, and/or the nozzle plate 120 will be deformed or cracked.

The peeling of the seal tape causes stress in the area of contact, that is, area of bonding, between the ink passage wall and substrate. The effect of this stress is greater when the seal tape is peeled from the side where the ink passage wall is wider, that is, the side where the column of larger diameter nozzles is, being therefore more likely to cause the nozzle plate to separate from the substrate, and/or the nozzle plate to crack.

As a means for preventing this problem, it is possible to coat the portion of the seal tape, which corresponds to the ink ejection surface, with protective liquid, instead of adhesive. In recent years, however, in order to deal with the demand for an ink jet printer capable of forming a more precise and more brilliant image, various innovative inks have been developed. As a result, it has become difficult to find proper protective liquid.

Further, in the case of the ink jet head shown in FIG. 7, it was necessary to keep the ink ejection surface sealed with a flexible member to prevent inks from mixing. This requirement for the flexible member sometimes added to the cost of an ink jet head.

SUMMARY OF THE INVENTION

The present invention relates to an ink jet head, which is usable with a seal tape for keeping the ink ejection surface of an ink jet head sealed to prevent inks from leaking and/or mixing during the shipment of the ink jet head, and its primary object is to provide an ink jet head which does not suffer from the problem that the nozzle plate of an ink jet head becomes separated from the substrate of the ink jet head, and/or cracks, when the seal tape bonded to the ink jet head is peeled.

According to an aspect of the present invention, there is provided an ink jet head comprising an elongated ink supply port extending in a longitudinal direction; a plurality of head groups, each of which comprises at least three head elements, arranged in a transverse direction crossing with the longitudinal direction, each of said head elements comprising a part of said ink supply port, a first array of ink ejection outlets for ejecting ink, ink passages for fluid communication between said ink ejection outlets of the first array and the part of said ink supply port, a second array of ink ejection outlets for ejecting ink, ink passages for fluid communication between said ink ejection outlets of the second array and the part of said ink supply port, a third array of ink ejection outlets for ejecting ink, and ink passages for fluid communication between said ink ejection outlets of the third array and a part of said ink supply port, and partition walls between adjacent ink passages, wherein said first array of the ink ejection outlets is disposed along one lateral side of the part of said ink supply port, said second and third arrays of the ink ejection outlets are disposed along the other lateral side of said ink supply port, wherein widths L2, measured in the longitudinal direction, of said partition walls for said first array of the ink ejection outlets are larger than widths L1, measured in the longitudinal direction, of said partition walls of said second and third arrays of the ink ejection outlets, and said ink jet head further comprises a sealing tape for protecting said ejection outlets, said sealing tape being peelable in a direction from said second or third array toward said first array in each of said head elements.

According to another aspect of the present invention, there is provided an ink jet head comprising an elongated ink supply port extending in a longitudinal direction; a plurality of head groups, each of which comprises at least three head elements, arranged in a transverse direction crossing with the longitudinal direction, each of said head elements comprising a part of said ink supply port, a first array of ink ejection outlets for ejecting ink, ink passages for fluid communication between said ink ejection outlets of the first array and the part of said ink supply port, a second array of ink ejection outlets for ejecting ink, ink passages for fluid communication between said ink ejection outlets of the second array and the part of said ink supply port, a third array of ink ejection outlets for ejecting ink, ink passages for fluid communication between said ink ejection outlets of the third array and a part of said ink supply port, a fourth array of ink ejection outlets for ejecting ink, ink passages for fluid communication between said ink ejection outlets of the fourth array and the part of said ink supply port, a fifth array of ink ejection outlets for ejecting ink, ink passages for fluid communication between said ink ejection outlets of the fifth array and the part of said ink supply port, and partition walls between adjacent ink passages, wherein said first and fourth arrays of the ink ejection outlets are disposed along one lateral side of the part of said ink supply port, said second, third and fifth arrays of the ink ejection outlets are disposed along the other lateral side of said ink supply port, wherein widths L2, measured in the longitudinal direction, of said partition walls for said first array of the ink ejection outlets are larger than widths L1, measured in the longitudinal direction, of said partition walls for said second and third arrays of the ink ejection outlets, wherein widths L3, measured in the longitudinal direction, of said partition walls for said fourth array of the ink ejection outlets are larger than widths L4, measured in the longitudinal direction, of said partition walls for said fifth array of the ink ejection outlets, and said ink jet head further comprises a sealing tape for protecting said ejection outlets, said sealing tape being peelable in a direction from said second, third or fifth array toward said first or fourth array in each of said head elements.

According to the present invention, an ink jet head is structured to ensure that a seal tape is peeled from the side where the ink jet head is less resistant to the stress generated by the peeling of the seal tape, toward the side where the ink jet head is more resistant to the stress, regardless of the number of head elements, for example, three or more head elements, and also, regardless of the position of each of the head elements arranged side by side in parallel. Therefore, an ink jet head in accordance with the present invention does not suffer from the problem that the ink passage wall of the ink jet head is separated from the substrate of the ink jet head by the force applied to the seal tape to peel the seal tape, and/or the problem that the nozzle plate of the ink jet head is made to crack in adjacencies of the nozzles by the force applied to the seal tape to peel the seal tape.

Thus, the present invention makes it possible to provide an ink jet head which does not suffer from the problem that recording liquid evaporates and/or splashes from the ink ejection nozzles of an ink jet head, the problem that foreign matters adhere to the opening or adjacencies of the ink ejection nozzle of an ink jet head, and the problem that the ink passage wall of an ink jet head becomes separated from the substrate of the ink jet head when a protection tape is peeled from the ink jet head after the shipment of the ink jet head. In other words, the present invention makes it possible to provide a highly reliable ink jet head protected by the protection tape bonded to the ink jet head, more specifically, an ink jet head which does not require a user to follow a specific procedure or be extremely careful when removing a seal tape to use the ink jet head, that is, an ink jet head which is very easy to use.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 2(*b*) is an enlarged sectional view of a part of the ink jet head cartridge, shown in FIG. 1(*a*), at Line B-B; and FIG. 2(*c*) is an enlarged sectional view of a part of the ink jet head cartridge, shown in FIG. 1(*a*).

DETAILED DESCRIPTION OF THE PREFERRED EMBODIMENTS

Hereinafter the preferred embodiments of the present invention will be described in detail with reference to the appended drawings.

Figure 1:
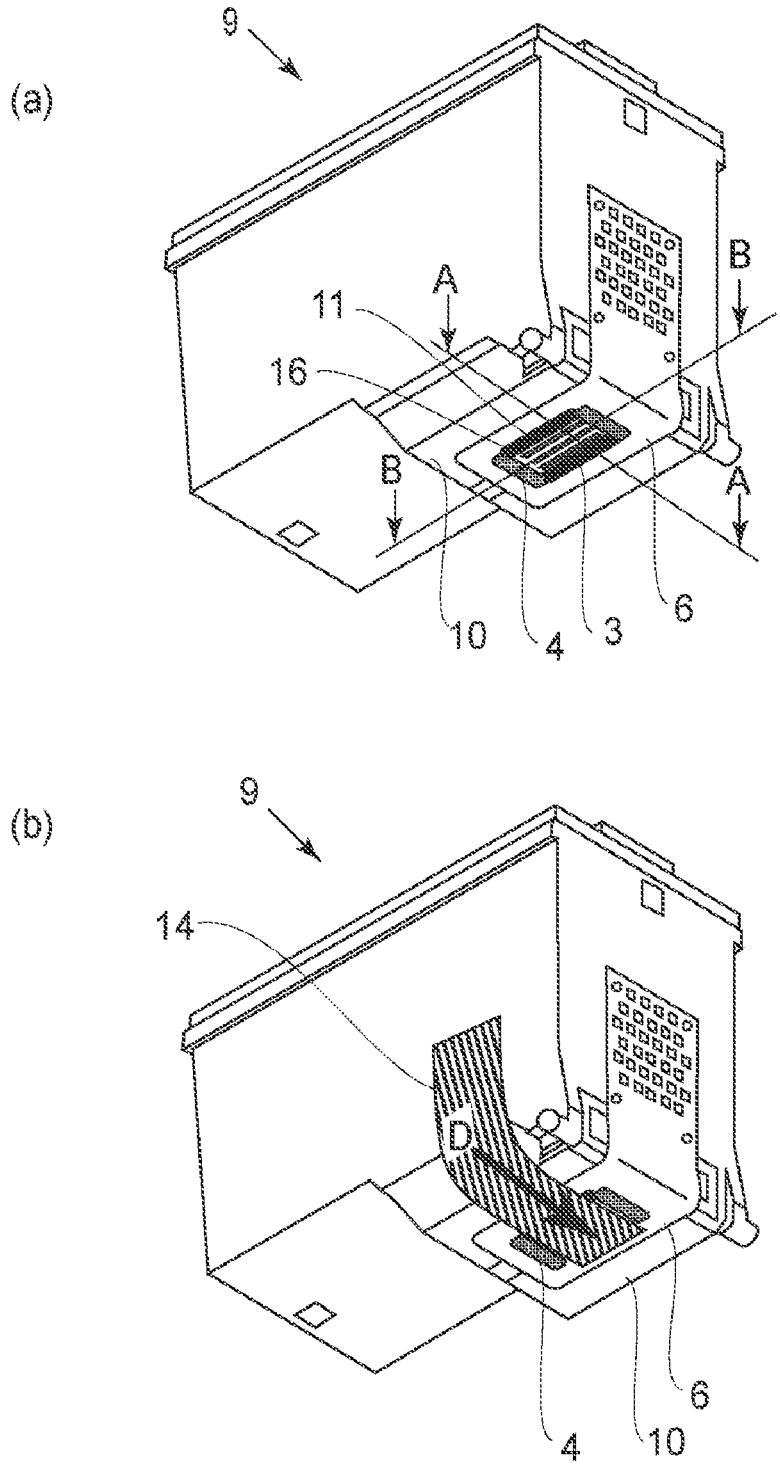
FIG. 1(*a*) is an external perspective view of an ink jet head cartridge without its sealing tape, and FIG. 1(*b*) is an external perspective view of the ink jet head cartridge shown in FIG. 1(*a*), with its sealing tape adhered thereto.

The external structural features of an ink jet cartridge made up of a liquid jetting head are shown, without and with its sealing tape, in FIGS. 1(*a*) and 1(*b*), respectively.

Referring to FIG. 1(*a*), an ink jet head cartridge 9 is made up of an ink container portion, which is an ink supply source, and a liquid jetting head (which hereafter may be referred to simply as head) which is in the form of a chip integrated with the ink container portion. It is a body of first sealant 3 that keeps the head attached to the ink delivery portion 10 of the ink container. The head is provided with an electrical wiring plate 6 (TAB) which maintains electrical connection between the head and the main assembly of an ink jet recording apparatus. The TAB 6 is attached to the ink container portion and ink delivery portion 10 so that it straddles the two portions. The junctions between the electrodes of the head and the corresponding electrodes of the TAB 6 are covered (sealed) with the body of second sealant 4.

Referring to FIG. 1(*b*), before the ink jet head is used for the first time, the ink ejection surface of the head remains sealed with a protection tape, which is attached to the surface to protect the head against external elements, such as the impacts to which the head is subjected during its shipment. The ink jet head and protection seal are structured so that the protection seal is to be peeled away in the direction indicated by an arrow mark D in FIG. 1(*b*).

Figure 2:
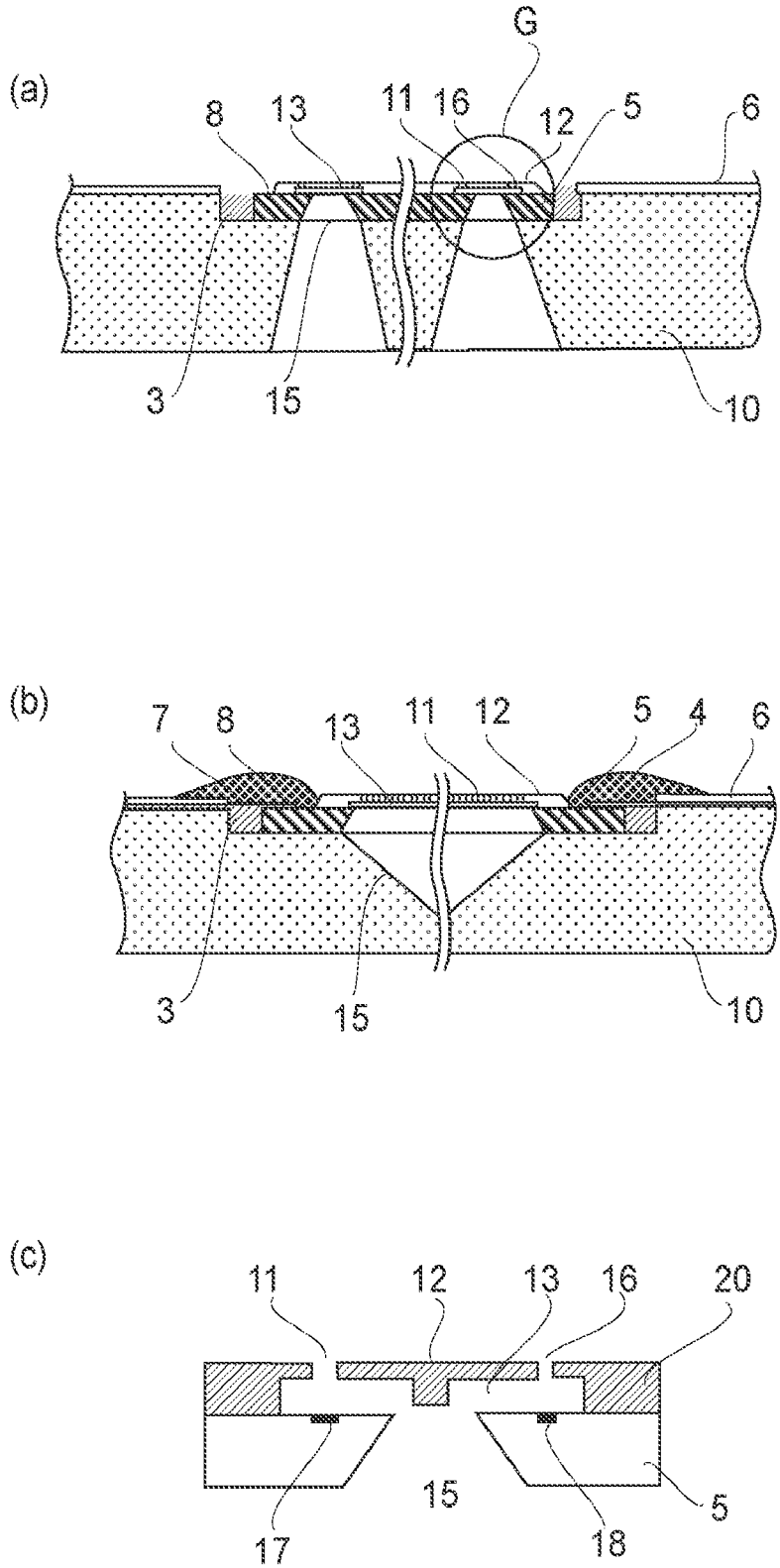
FIG. 2(*a*) is an enlarged sectional view of a part of the ink jet head cartridge, shown in FIG. 1(*a*), at Line A-A in FIG. 1(*a*)

The general structure of the head is shown in FIGS. 2(*a*)-2(*c*). FIG. 2(*a*) is a sectional view of a part of the ink jet head cartridge, shown in FIG. 1(*a*), at Line A-A in FIG. 1(*a*). FIG. 2(*b*) is a sectional view of a part of the ink jet head cartridge, shown in FIG. 1(*a*), at Line B-B in FIG. 1(*a*). FIG. 2(*c*) is an enlarged sectional view of a part G of the ink jet head cartridge, shown in FIG. 2(*a*).

Referring to FIGS. 2(*a*)-2(*c*), a substrate 5 of the head, which is formed of silicon, is attached to the ink delivery portion 10 of the ink container with the use of the body of first sealant 3 (which hereafter will be referred to simply as first sealant 3). The substrate 5 is provided with common ink delivery channels 15, which receive ink from the ink container portion and deliver the ink to multiple ink ejection outlets arranged in multiple columns. Referring to FIG. 2(*b*), the substrate 5 is structured so that each common ink delivery channel 15 extends from one end of each of the two columns of ink ejection nozzles located on each side of the common ink delivery channel 15, one for one, to the other. Next, referring to FIG. 3, the common ink delivery channel 15 receives ink from the ink supply source, and delivers the ink to multiple columns of ink ejection nozzles, that is, the columns of first ink ejection nozzles 11, columns of second ink ejection nozzles 16, and columns of third ink ejection nozzles 21. The head is provided with multiple columns of ink ejection energy generating elements, that is, the columns of first ink ejection energy generating elements 17, columns of second ink ejection energy generating elements 18, and columns of third ink ejection energy generating elements 22 (FIG. 3(*c*)), which are placed on the substrate 5 in such a manner that the first, second, and third ink ejection energy generating elements align with the first, second, and third ink ejection nozzles, one for one. Further, the head is provided with a nozzle plate 20, which is bonded to the substrate 5. The nozzle plate 20 is formed of a liquid passage formation material, and has liquid passage walls 19, which separate ink passages 13 which connect the common ink delivery channel 15 to ink ejection nozzles 11, 16, and 21. There are three straight columns of ink ejection nozzles, which are parallel to the lengthwise direction of the common ink delivery channel 15. In each column of ink ejection nozzles, the ink ejection nozzles are arranged with preset intervals (which hereafter will be referred to as pitch). The column of ink ejection nozzles 16 and column of ink ejection nozzles 21 are on one side of the common ink delivery channel 15, and the column of ink ejection nozzles 11 is on the other side of the common ink delivery channel 15.

Figure 3:
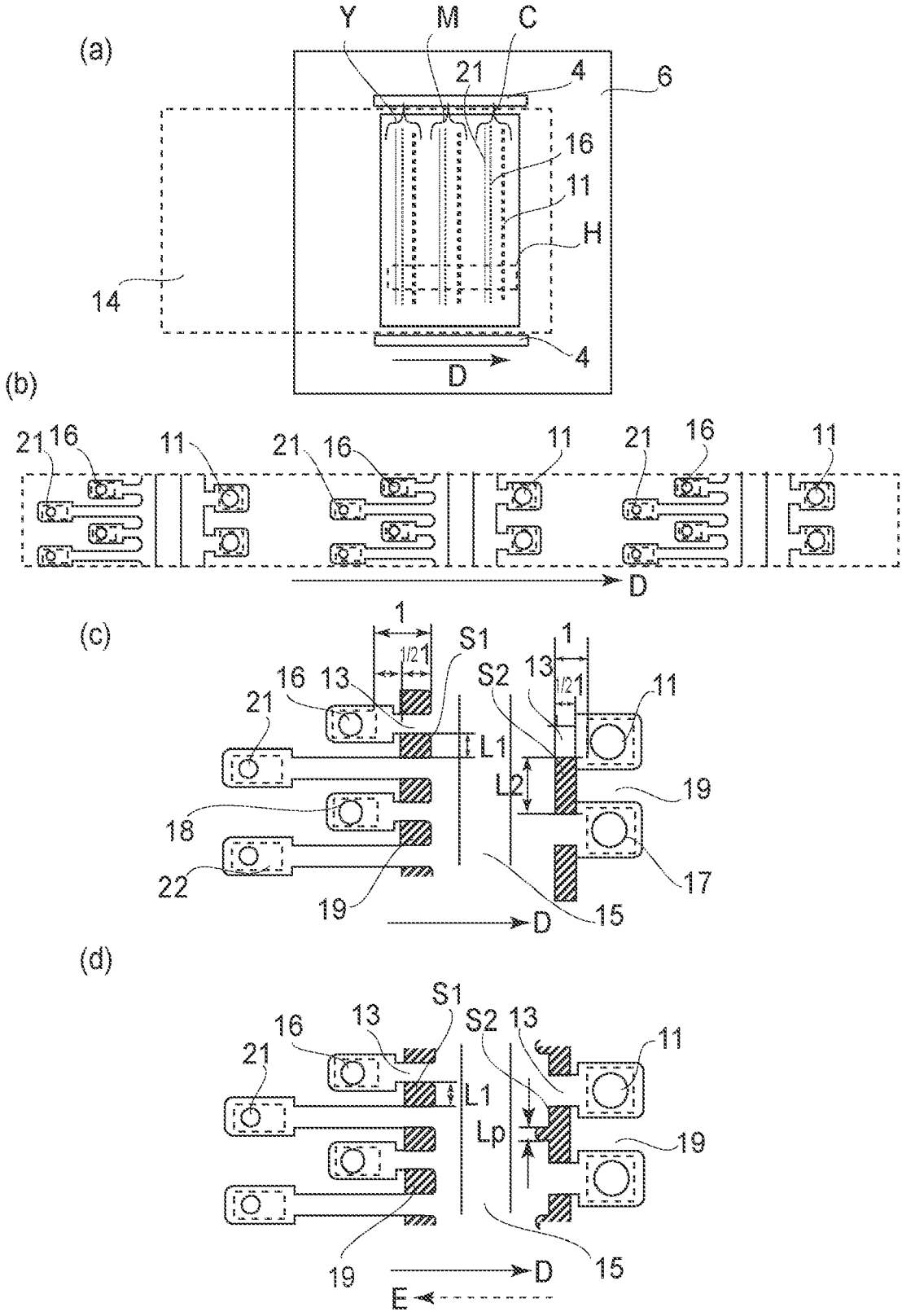
FIGS. 3(*a*)-3(*d*) are schematic drawings which show the structure of the ink jet head in the first embodiment of the present invention.

A combination of the substrate 5, ink delivery channel 15, ink ejection energy generating elements 17, 18, 22, ink ejection nozzles 11, 16, and 21, nozzle plate 20, ink passage which connects the common ink delivery channel 15 with the ink ejection nozzles 11, 16, and 21, and liquid passage wall 19 which separates adjacent two ink passages, is referred to as head elements. FIG. 3(*a*) shows an ink jet head having three head elements arranged side by side in parallel.

There is electrical wiring (formed by patterning), in addition to the ink ejection energy generating elements (electrothermal transducers), on the substrate 5. The structural component (ink ejection nozzle plate 20) having the ink passages 13, columns of first ink ejection nozzles 11, column of second ink ejection nozzles 16, and column of third ink ejection nozzles 21, is formed of a resinous substance, by photolithography. The top surface of this structural component (ink ejection nozzle plate 20), except for the openings of the columns of ink ejection nozzles 11, 16, and 21, is coated with a layer of water repellent substance 12. In other words, the outward surface of this water repellent layer 12 is the external surface of the ink jet head. There are also electrical wiring, electrodes 8, etc., on the substrate 5.

The TAB 6 is a part of the electric signal path which delivers electric signals to the electrical wiring on the substrate 5. It is provided with a hole for accommodating the substrate 5. There are electrodes 7 (electrical terminals) near the edge of this hole. The electrodes 7 are connected to the electrodes 8 of the chip. The chip and TAB 6 are bonded to the ink delivery portion 10 molded of a resinous substance. The gaps between the substrate 5 and TAB 6, and the electrical junctions between the substrate 5 and TAB 6 are sealed with a body of first sealant 3, which is for sealing the underside of the electrical junctions and the gap between the substrate 5 and TAB 6, and a body of second sealant 4, which is for sealing the top side of the electrical junctions, to prevent the electrical junctions from being corroded by ink, and also, to protect the electrical junctions from external impacts.

Next, examples of a liquid ejection head structured as described above, and examples of a protection tape to be bonded to a liquid ejection head to protect the head, will be concretely described with reference to drawings.

Embodiment 1

In the case of the head and head elements shown in FIGS. 3(*a*)-3(*d*), the column of first ink ejection nozzles 11 is on one side of the common ink delivery channel 15, whereas the columns of second and third ink ejection nozzles 16 and 21, respectively, are on the other side of the common ink delivery channel 15. The ink ejection nozzles, 11, 16, and 21 are 5 pl, 2 pl, and 1 pl, respectively, in the amount by which they jet ink per ejection. They are arranged in the direction parallel to the lengthwise direction of the common ink delivery channel 15 at 600 dpi.

That is, the columns of large diameter nozzles (columns of first nozzles) is on one side of the common ink delivery channel 15, whereas the column of medium diameter nozzles (column of second nozzles) and the column of small diameter nozzles (column of third nozzles) are on the other side of the common ink delivery channel 15.

Referring to FIG. 3(*a*), the ink jet head in this embodiment is an example of an ink jet head which uses three different inks, that is, cyan (C), magenta (M), and yellow (Y) inks. It has three head elements for cyan (C), magenta (M), and yellow (Y) inks, one for one, which are arranged side by side in parallel. As will be described below, these three head elements are the same in structure (amount by which ink is jetted from nozzle per ejection, nozzle density (pitch), nozzle arrangement).

FIG. 3(*b*) is an enlarged view of a portion H of FIG. 3(*a*), and FIG. 3(*c*) is an enlarged view of one of the head elements shown in FIG. 3(*b*). Referring to FIG. 3(*c*), the ink passage walls 19 of the ink passages 13 which connect the common ink delivery channel 15 to the ink ejection nozzles 11, 16, and 12 are different in width. That is, the width of each ink passage wall 19 corresponds to the amount by which ink is jetted per ejection from the ink ejection nozzle of the corresponding ink passage. In FIG. 3, L1 stands for the dimension (which hereafter may be referred to as end width), in terms of direction parallel to the lengthwise direction of the common ink delivery channel 15, of the portion of the ink passage wall 19 (which is between the ink passage leading to ink ejection nozzle 16, that is, 2 pl ink ejection nozzle, and the ink passage leading to ink ejection nozzle 21, that is, 1 pl ink ejection nozzle), which faces the common ink delivery channel 15, and L2 stands for the dimension (which hereafter may also be referred to as end width), in terms of the direction parallel to lengthwise direction of common ink delivery channel 15, of the portion of the ink passage wall 19 of the ink passage leading to ink ejection nozzle 11, that is, 5 pl ink ejection nozzle), which faces the common ink delivery channel 15. In the case of the ink jet head in this embodiment (ink jet head in accordance with present invention), the first ink ejection nozzles 11 are aligned at 600 dpi, whereas the second ink ejection nozzles 16 and third ink ejection nozzles 21 are aligned at 1,200 dpi. Therefore, the ink passage walls of the ink passages leading to the ink ejection nozzles 16 and 21, that is, the ink ejection nozzles which are higher in pitch than the ink ejection nozzle 11, are narrower in width than the ink passage walls of the ink passages leading to the ink ejection nozzles 11. Therefore, L1<L2.

Referring to FIG. (3*a*), a broken line shows the contour of the protection tape attached to the ink jet head. As will be evident from the drawing, the protection tape is attached to the ink jet head so that its lengthwise direction becomes parallel to the direction in which the head elements are arranged side by side in parallel. In the case of the head shown in FIG. 3(*a*), the three head elements, which are the same in structure as described above, are arranged side by side in parallel. In other words, the ink jet head is structured so that as the seal tape 14 is peeled in the direction indicated by the arrow mark D, it is peeled from each head element, from the side on which the end width of the ink passage wall 19 is narrower (L1), toward the side on which the end width of the ink passage wall 19 is wider (L2). That is, the seal tape 14 is peeled from the side on which the amount of stress to which the ink jet head is subjected by the peeling of the seal tape 14 is smaller, toward the side on which the stress is greater. In the case of this ink jet head, for the purpose of showing a user (operator) the direction in which the protection tape 14 is to be peeled, the protection tape 14 is bonded to the ink jet head in such a manner that one of its lengthwise ends extends, as a pull-tab, beyond the edge of the ink jet head.

In this embodiment, the ink jet head is structured as described above, and the protection tape 14 is attached to the ink jet head so that it is to be peeled in the above-described direction. Thus, the portion of the protection tape 14, which corresponds to the portion of the ink jet head, which is greater (L2) in the area of bond between the substrate 15 and ink ejection nozzle plate 20, is peeled after the opposite portion of the protection tape 14 is peeled. Therefore, the ink jet head in this embodiment is more resistant to the stress attributable to the peeling of the protection tape 14. That is, it does not suffer from the problem that the nozzle plate 20 is separated from the substrate 15 by the stress caused by the peeling of the protection tape against the bond between the protection tape and ink ejection surface.

In this embodiment, the ink jet head is structured so that the walls of the ink passages leading to the ink ejection nozzles which are greater in pitch are narrower than the walls of the ink passages leading to the ink ejection nozzles which are less in pitch, as described above. Therefore, the protection tape is bonded to the ink jet head so that it is to be peeled from the side on which the ink ejection nozzles are higher in pitch, toward the side on which the ink ejection nozzles are lower in pitch (direction indicated by arrow mark D in drawing). In other words, it may be stated that the protection tape is bonded to the ink jet head so that it is to be peeled from the side on which the ink passage walls are narrower (L1), toward the side on which the ink passage walls are wider (L2).

Incidentally, in a case where the ink passage walls have been modified in shape as shown in FIG. 3(*d*), if the protection tape 14 is bonded to the ink jet head so that it is to be peeled from the side on which the ink passage walls are narrower, toward the side on which the ink passage walls are wider, the portion of the protection tape 14, which corresponds to the portion of the ink passage wall, which has a width of Lp, and the portion of the protection tape 14, which corresponds to the portion of the ink passage wall, which has a width of L1, are peeled from the side of the portion with a width of Lp toward the side of the portion with a width of L1, that is, the direction indicated by a dotted arrow mark E. From the viewpoint of the stress caused by the peeling of the protection tape 14, this degree of modification has little effect. In practical terms, the direction indicated by the arrow mark E is opposite to the direction in which the protection tape 14 is to be peeled in this embodiment. Therefore, it is possible that the peeling of the protection tape 14 will cause the ink ejection nozzle plate to separate from the ink passage walls, or the like problem.

Thus, the inventors of the present invention paid attention to the size of the area of contact (which hereafter may be referred to as area of wall contact) between the ink passage wall 19 and substrate 5, which is represented by the hatched portion in FIG. 3(*d*). Referring to FIG. 3(*c*), l stands for the distance from the lengthwise end of the ink passage wall, which is on the ink delivery channel side, and the edge of the ink ejection energy generating element, which is on the ink delivery channel side. By comparing in size the portion of the ink passage wall, which is between the abovementioned edge of the ink ejection energy generating element and the midpoint (½ l) between this edge and the abovementioned lengthwise end of the ink passage wall, with the area S of contact between the substrate 5 and ink passage wall, the portion of the ink passage wall, which is between the abovementioned edge of the ink ejection energy generating element and the midpoint (½l) between this edge and the abovementioned lengthwise end of the ink passage wall, may be defined as such a portion that has no effect upon the ink ejection, even if the ink ejection nozzle plate is damaged by the peeling of the protection tape. In other words, only when the ink ejection nozzle plate is damaged beyond this area, the damage affects the ink ejection. From this standpoint, the area S1 of wall contact, on the side on which the ink ejection nozzles are arranged at 1,200 dpi, is smaller than the area S2 of wall contact, on the side on which the ink ejection nozzles are arranged at 600 dpi. That is, the protection tape is bonded to the ink jet head so that it can be peeled from the side on which the area S of contact is smaller, that is, from the area S1, toward the side on which the area S of contact is larger, that is, the area S2, regardless of the modification of the ink passage wall. By structuring the ink jet head as described above, and bonding the protection tape as described above, it is possible to provide an ink jet head which is not derogatorily affected by the peeling of the protection tape, and also, it is possible to reliably inform a user (operator) of the direction in which the protection tape is to be peeled.

Figure 4:
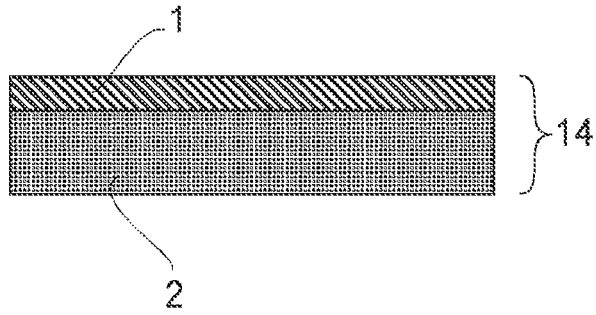
FIG. 4 is a schematic sectional view of the protective tape.
Figure 7:
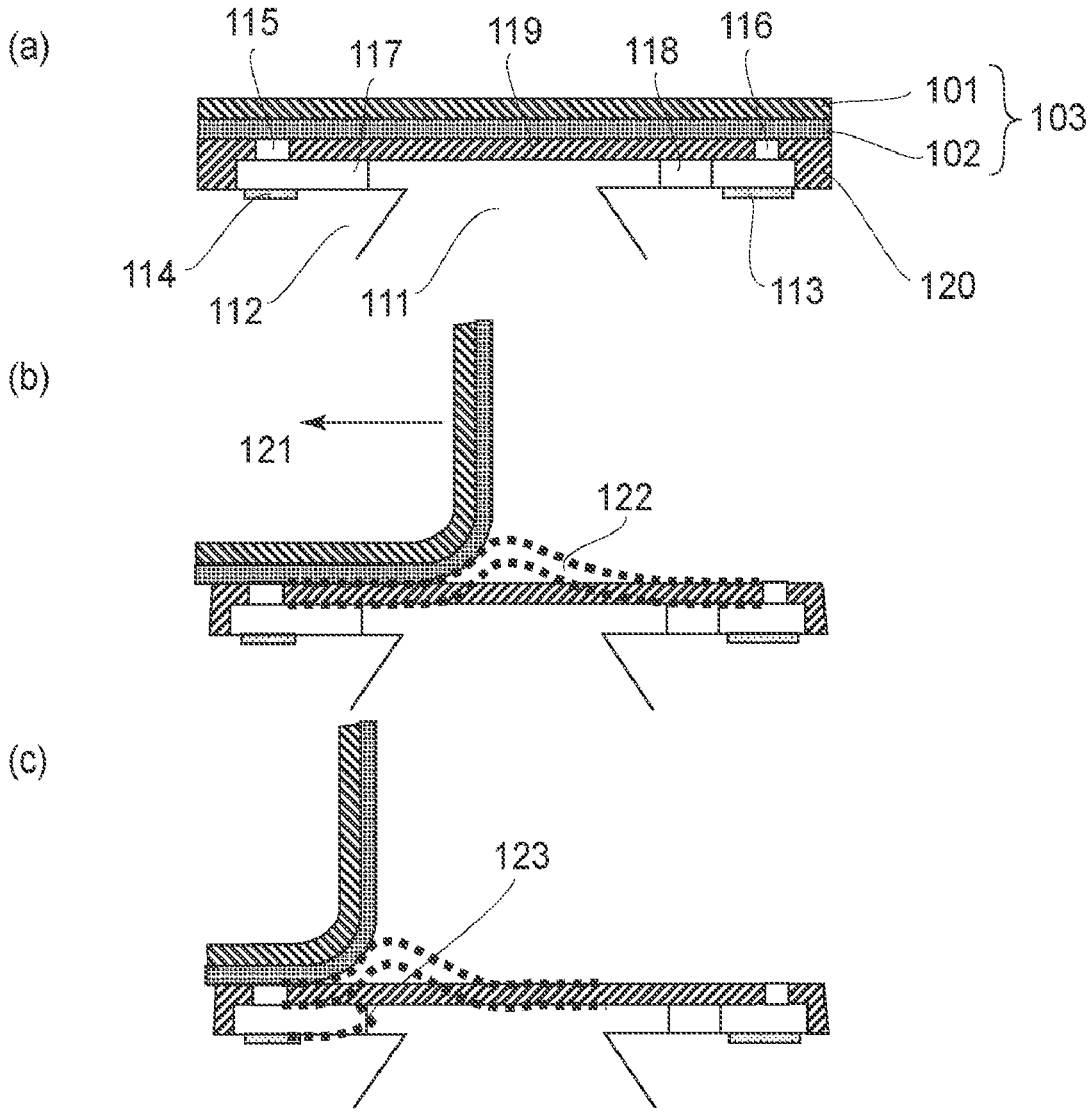
FIGS. 7(*a*)-7(*c*) are schematic sectional views of the protection tape, showing the state of the protection tape in various stage of its removal.

FIG. 4 is a schematic sectional view of the protection tape 14, which shows the structure of the protection tape 14. As is evident from FIG. 4, the substrate 1 of the protection tape 14 is formed of PET film, and is 12 μm in thickness. The substance of which the bonding layer 2 is formed is an acrylic adhesive. That is, the protection tape 14 is made up of the substrate 1 formed of PET film, and the bonding layer 2 formed on the substrate 1 by applying the adhesive to the substrate 1 to a thickness of 30 μm.

Figure 5:
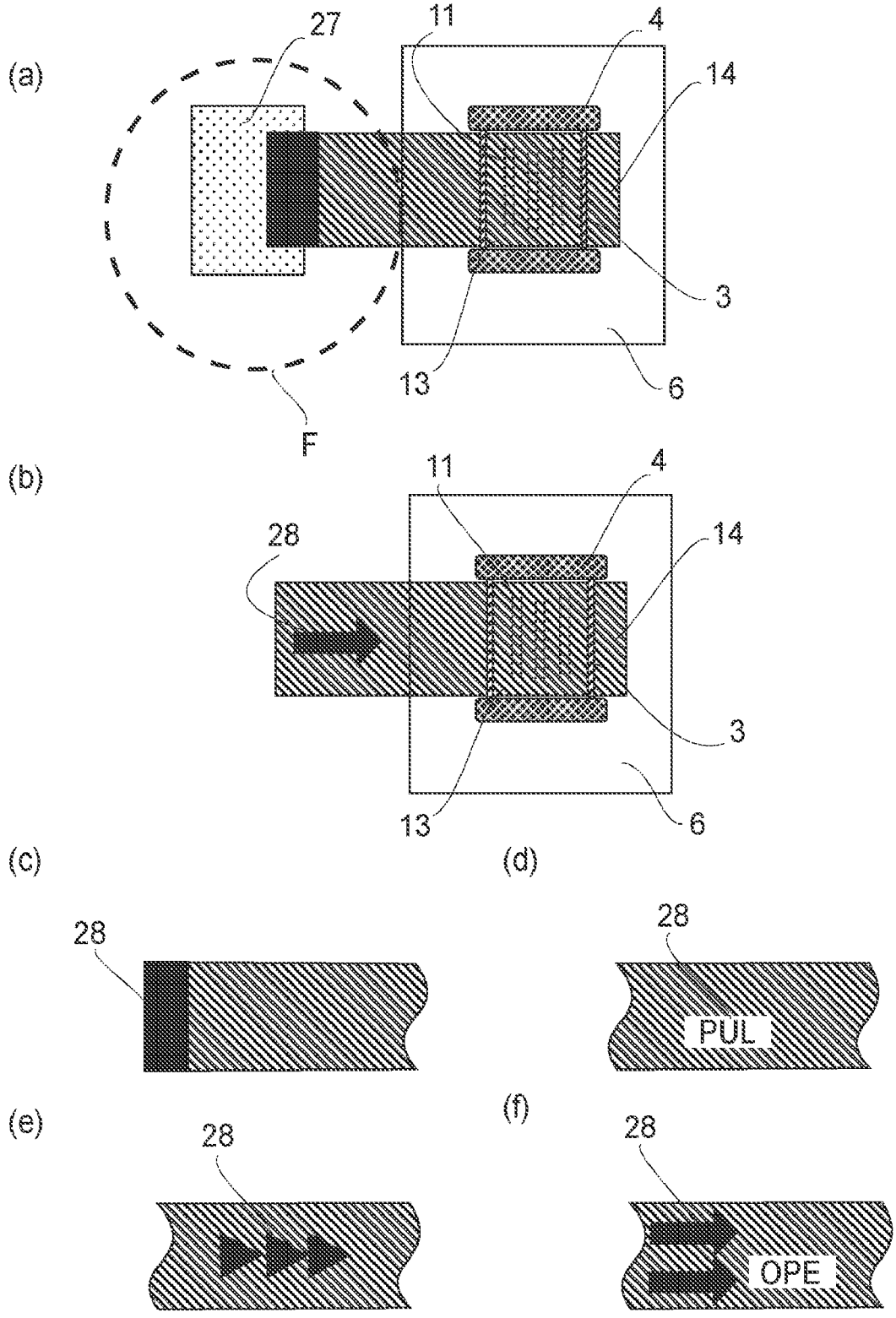
FIGS. 5(*a*)-5(*f*) are drawings of various protection tapes, one for one.

Referring to FIG. 5(*a*), the protection tape 14 is bonded to the ink jet head in such a manner that its lengthwise direction becomes perpendicular to the column of first ink ejection nozzles 11, column of second ink ejection nozzles 16, and column of third ink ejection nozzles 21. More specifically, it is desired that in terms of the direction parallel to the ink ejection nozzle columns, the dimension of the protection tape 14 is greater than the length of the ink ejection nozzle column, and is less than the distance between the body of second sealant 4, which is at one end of the ink ejection surface, and the body of second sealant 4, which is on the other end of the ink ejection surface. Incidentally, the protection tape 14 is bonded to the portions of the ink jet head, which do not protrude, that is, the portion other than the bodies of second sealant 14. Therefore, the protection tape 14 is not affected by the presence of the bodies of second sealant 4, which protrude from the ink ejection surface, and therefore, it is ensured that the protection tape 14 remains bonded fast to the ink jet head until it needs to be peeled.

Incidentally, in a case where the direction in which the protection tape 14 is to be peeled was made opposite from the direction indicated by the arrow mark D in FIG. 3, the ink ejection nozzle plate was sometimes separated from the substrate 5, in the area where the end width of the ink passage wall is narrow (L1: area S1 of wall contact), which affected the ink ejection from the liquid jetting head.

It is very important to the present invention to design an ink jet head so that the direction in which the seal tape 14 is to be peeled is clearly indicated to an operator. Thus, in order to specify the direction in which the seal tape 14 is to be peeled, that is, to prevent an operator from misunderstanding the direction in which the seal tape 14 is to be peeled, the seal tape 14 (protection tape) is provided with an extension (FIG. 1(*b*)), for example, which extends, as a pull-tab, beyond the edge of an ink jet head.

FIG. 5(*a*) shows another example of protection tape 14, which clearly shows an operator the pull-tab portion of the protection tape 14. In the case of the example shown in FIG. 5(*a*), a component 27, which is not an integral part of the protection tape 14, is attached to the protection tape 14. As for the methods for preventing the adhesive on the pull-tab portion of the protection tape 14 from sticking to the fingers of an operator, the extended portion of the protection tape 14 may be folded back to form the pull-tab portion, or the adhesive layer on a part of the extended portion of the protection tape 14 may be removed by processing it with a beam of laser light to turn the part into a pull-tab. Further, the surface of the adhesive layer on a part of the extended portion of the protection tape 14 may be processed to turn the part into the pull-tab. Moreover, the pull-tab portion of the protection tape 14 may be dimpled to prevent the pull-tab portion from adhering to the liquid jetting head.

FIGS. 5(*b*)-5(*f*) show other examples of protection tape 14, which are provided with a peeling direction indicating portion 28 having a sign for assuring that a user (operator) will recognize the direction in which the protection tape 14 is to be peeled. The peeling direction indicating portion 28 may, or may not, be an integral part of the protection tape 14.

The sign on the peeling direction indicating portion 28 may be an arrow (arrows), a rectangle, letters, combinations of preceding signs, etc., as shown in FIGS. 5(*b*)-5(*f*). Further, the protection tape 14 itself may be shaped to show the direction in which it is to be peeled.

Incidentally, sometimes, ink seeps out of the ink ejection nozzles 11 when the protection tape 14 is peeled. Thus, it is desired that in order to minimize the effects of the color mixture attributable to this seeping of ink, an ink jet head is designed so that the column of the ink ejection nozzles for the ink of lighter color is positioned on the upstream side, in terms of the peeling direction of the protection tape 14, and the column of the ink ejection nozzles for the ink of darker color is positioned on the downstream side. More specifically, it is desired that the ink jet head is structured so that the columns of the ink ejection nozzles for yellow (Y) ink is positioned most upstream, and the column of the ink ejection nozzles for magenta (M) ink and the column of the ink ejection nozzles for cyan (C) ink are positioned in the listed order. With the employment of this structural arrangement, even if a small amount of yellow (Y) ink seeps out and reaches the columns of the ink ejection nozzles for the magenta (M) ink while the protection tape 14 is peeled, the effect of the mixture of yellow (Y) ink into the magenta (M) ink, upon recording, is far smaller than the effect of the mixture of magenta (M) ink into the yellow (Y) ink, that is, the effect which the seeping of ink might have if the columns of ink ejection nozzles were not positioned as described above. The same can be said about the effect of the mixture of a small amount of cyan (C) ink into magenta (M). FIG. 3(*a*) shows an example of an ink jet recording head structured so that the ink ejection nozzle columns are arranged as described above. Incidentally, the ink jet head in this embodiment is structured so that the three columns of nozzles for yellow (Y), magenta (M), and cyan (C) inks are arranged side by side in parallel. Further, all the nozzle columns satisfy the relationship: end width L1<end width L2. In other words, the ink jet head in this embodiment is structured to make the peeling direction of the protection tape 14 such that the protection tape 14 is peeled from the side on which the end width of the ink passage wall is L1 (narrower), toward the side on which the end width of the ink passage wall is L2 (wider). Further, all the nozzle columns satisfy the relationship: area S1 of wall contact<area S2 of wall contact. That is, the ink jet head in this embodiment is structured to make the peeling direction of the protection tape 14 such that the protection tape 14 is peeled from the area S1 side toward the area S2 side.

In recent years, it has become a common practice to design an ink jet recording head to be reusable, from the viewpoint of reducing the impact of an ink jet recording apparatus (head) upon the environment. Thus, some disposable ink jet recording heads are designed to be reused by refilling them with ink. If an ink jet recording head reusable by refilling it with ink is stored or shipped with its ink ejection surface remaining exposed, the ink in the ink ejection nozzles is likely to plug the ink ejection nozzles, or to adhere to the ink ejection surface, by drying. As one of the effective means for preventing the ink in the ink ejection nozzles of a refilled ink jet head from drying, it is possible to paste the protection tape to the ink ejection surface of the refilled ink jet head, or cover the openings of ink ejection nozzles of the refilled ink jet head with a cap or the like, in the same manner as the protection tape is pasted to the ink ejection surface of a brand-new ink jet head, or the ink ejection surface of a brand-new ink jet head is capped, when an ink jet head is manufactured.

If the method of pasting the protection tape 14 across the ink ejection surface of a refilled ink jet head is taken, the effect of the peeling of the protection tape 14 upon the nozzles must be taken into consideration.

If ink ingredients are on the ink ejection surface, the protective tape fails to adhere to the portions of the ink ejection surface, across which the ink ingredients are present, and therefore, may allow ink to leak. Thus, the area of the ink ejection surface, across which the protection tape 14 is to be pasted, must be cleaned to remove the ink ingredients and the like from the area. As for the method for cleaning the ink ejection surface, there are various cleaning methods which do not derogatorily affect the ink ejection nozzles, for example, wiping, or washing with running water.

The protection tape 14 is to be pasted after the cleaning. It is to be pasted so that it is to be peeled in the same direction as that in this embodiment. Thereafter, the ink jet head may be stored or shipped out as merchandise.

As described above, not only is the present invention compatible with a case where an ink jet head is brand-new, but also, a case in which a protection tape (seal tape) is bonded to a refilled recyclable ink jet head to be stored.

Embodiment 2

Figure 6:
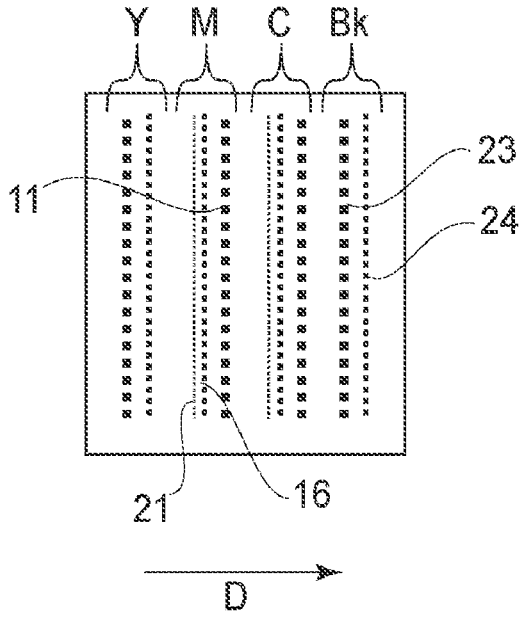
FIGS. 6(*a*) and 6(*b*) are schematic drawings of the ink jet head in the second embodiment, showing the structure of the ink jet head.
Figure 6:
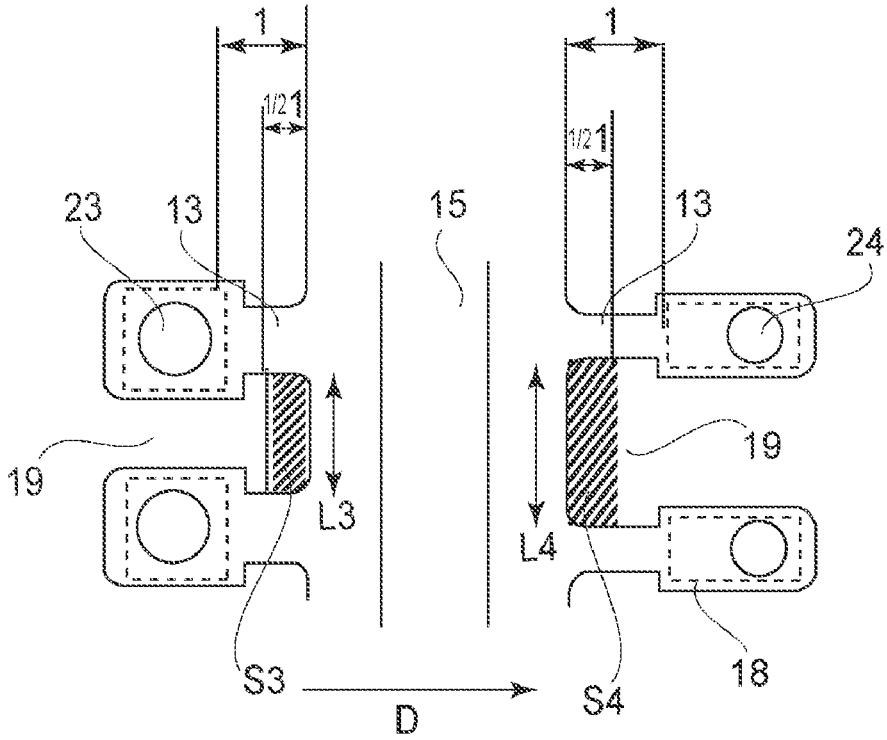

FIG. 6(*a*) shows the ink jet head in the second embodiment of the present invention. The head in this embodiment is structured to use four head elements for yellow (Y), magenta (M), cyan (C), and black (Bk) inks, one for one, which are arranged side by side (left to right in drawing) in parallel. More specifically, the head element for yellow (Y) ink and the head element for black (Bk) ink are next to the left and right edges (in drawing) of the substrate 5, and the head elements for magenta (M) and cyan (C) inks, one for one, are on the middle portion of the substrate 5. Incidentally, the basic structure of the ink jet head in this embodiment is similar to that in the first embodiment, and therefore, will not be described in detail.

Also in this embodiment, both the head element for magenta (M) and the head element for cyan (C) ink are structured so that the column of the first ink ejection nozzles 11 is on one side of the ink delivery channel 15, and the column of the second ink ejection nozzles 16 and the column of the third ink ejection nozzles 21 are on the other side of the common ink delivery channel 15, as they are in the first embodiment.

The head element for yellow (Y) ink and the head element for black (Bk) ink are made up of two different ink ejection nozzles. An example of their structure is shown in FIG. 6(*b*).

That is, ink ejection nozzles 23 which are 5 pl in the amount by which they jet ink per ejection are aligned on one side of the common ink delivery channel 15 at 600 dpi, forming the column of fourth ink ejection nozzles 23, and ink ejection nozzles 24 which are 2 pl in the amount by which they jet ink per ejection are aligned on the other side of the common ink delivery channel 15 at 600 dpi, forming the column of fifth ink ejection nozzles 24.

Generally, when recording is made using four different inks, for example, black, cyan, magenta, and yellow inks, black ink is used to record characters, and also, used for the inking of an image recorded with the combination of cyan, magenta, and yellow inks. Therefore, black ink is rarely used in the form of an extremely minute ink droplet. Further, in the case of an image recorded with the combination of the same amounts of cyan, magenta, and yellow inks, the areas of the image recorded with cyan or magenta ink are likely to appear grainier than the areas of the image recorded with yellow ink. Therefore, reducing the ink ejection nozzles for cyan and magenta inks among the four different inks, that is, black, cyan, magenta, and yellow inks, in the amount by which they eject ink per ejection is effective to improve an ink jet recording head in image quality. This is why the ink jet recording head in this embodiment is structured so that the ink ejection nozzles for cyan ink, and the ink ejection nozzles for magenta ink, are significantly smaller in the amount by which they eject ink per ejection.

Referring to FIG. 6(*b*), the ink jet recording head in this embodiment is structured so that the ink passage walls 19 of the ink passage 13 which connect the common ink delivery channel 15 to the ink ejection nozzles 23 and 24 are different in width (dimension in terms of direction parallel to lengthwise direction of ink delivery channel); the width of ink passage wall 19 is made to correspond to the amount (or ink ejection nozzle diameter) by which ink is ejected per ejection from the ink ejection nozzle to which the ink passage formed by the ink passage wall 19 leads. Also referring to FIG. 6(*b*), L3 stands for the dimension (which hereafter may be referred to as end width), in terms of direction parallel to lengthwise direction of common ink delivery channel 15, of the portion of the ink passage wall 19, which is next to ink ejection nozzle 23, that is, 5 pl ink ejection nozzle, and faces the common ink delivery channel 15, whereas L4 stands for the dimension (which hereafter may also be referred to as end width), in terms of direction parallel to lengthwise direction of common ink delivery channel 15, of the portion of the ink passage wall 19 of ink passage leading to ink ejection nozzle 24, that is, 2 pl ink ejection nozzle, which faces the common ink delivery channel 15. In the case of the ink jet head in this embodiment (ink jet head in accordance with present invention), both the ink ejection nozzles 23 and ink ejection nozzles 24 are aligned at 600 dpi. However, the ink ejection nozzle 23 and ink ejection nozzle 24 are different in diameter. Therefore, the ink passage wall 19 which corresponds to the ink ejection nozzle which is larger in diameter is made less in width (ink passage wall 19 which corresponds to ink ejection nozzle which is smaller in diameter is made greater in width). That is, the ink jet recording head is structured to satisfy the end width relationship: L3<L4.

When the protection tape 14 is used with the head shown in FIG. 6(*b*), it is to be bonded to the head so that it is to be peeled from the side where the end width of the ink passage wall is L3, that is, the side where the ink passage wall is narrower at its end facing the ink delivery channel, toward the side where the width of the ink passage wall is L4, that is, the side where the ink passage wall is wider at its end facing the ink delivery channel.

With the head structured as described above, and the protection tape 14 bonded as described, the portion of the protection tape 14, which corresponds in position to the portion of the area of contact (bonding) between the substrate 15 and ink ejection nozzle plate, which is greater in size, that is, the portion which corresponds to L4, is peeled toward the end of the peeling operation. Therefore, the head is more resistant to the stress attributable to the peeling of the protection tape 14 than a head structured differently. Therefore, the substrate 15 and ink ejection nozzle plate of the head in this embodiment is not likely to be separated from each other by the stress caused by the peeling of the protection tape 14.

Incidentally, the above described structural arrangement of an ink jet head can be described from the standpoint of the size of the area of contact (bonding) between each ink passage wall 19 and substrate 5 (which hereafter may be referred to as area of wall contact). Referring to FIG. 6(*b*), l stands for the distance from the lengthwise end of the ink passage wall, which is on the ink delivery channel side, and the edge of the ink ejection energy generating element, which is also on the ink delivery channel side. By comparing in size the portion of the ink passage wall, which is between the abovementioned edge of the ink ejection energy generating element and the midpoint (½ l) between this edge and the abovementioned lengthwise end of the ink passage wall, with the area S of contact between the substrate 5 and ink passage wall 19, the portion of the ink passage wall, which is between the abovementioned edge of the ink ejection energy generating element and the midpoint (½ l) between this edge and the abovementioned lengthwise end of the ink passage wall, may be defined as such a portion that has no effect upon the ink ejection, even if the ink ejection nozzle plate is damaged by the peeling of the protection tape. In other words, only when the ink ejection nozzle plate is damaged beyond this area, the damage affects the ink ejection.

From this standpoint, the area S3 of wall contact, that is, the area of wall contact on the side on which the ink ejection nozzles 23, that is, the ink ejection nozzles with a larger diameter, is smaller than the area S4 of wall contact, that is, the area of wall contact on the side on which the ink ejection nozzles 24, that is, the ink ejection nozzles with a larger diameter, are aligned. In this case, the protection tape is bonded to the ink jet head so that it is to be peeled from the side on which the area S of wall contact is smaller, that is, from the area S3 side, toward the side on which the area S of wall contact is larger, that is, the area S4 side. By structuring the ink jet head as described above, and bonding the protection tape as described above, it is possible to provide an ink jet head which is not derogatorily affected by the peeling of the protection tape, and also, it is possible to reliably inform a user (operator) of the direction in which the protection tape is to be peeled.

Referring to FIG. 6(*a*), the ink jet head in this embodiment is structured so that the four columns of nozzles for jetting yellow (Y), magenta (M), cyan (C), and black (Bk) inks, one for one, are arranged side by side (left to right in drawing) in parallel in the listed order. More specifically, the head element for yellow (Y) ink is made up of a column of nozzles with a larger diameter, and a column of nozzles with a smaller diameter. The column of nozzles with the larger diameter is on the left side of the column of nozzles with the smaller diameter (in terms of direction indicated by arrow mark D). The head element for magenta (M) ink is made up of a column of nozzles with a smaller diameter, a column of nozzles with a medium diameter, and a column of nozzles with a larger diameter, which are arranged side by side in parallel. The head element for cyan (C) ink is also made up of a column of nozzles with a smaller diameter, a column of nozzles with a medium diameter, and a column of nozzles with a larger diameter, which are arranged side by side in parallel. The head element for black (Bk) ink is made up of a column of nozzles with a larger diameter, and a column of nozzles with a smaller diameter, which are arranged side by side in parallel. To pay attention to the width of the lengthwise end of each ink passage wall, in the case of the two columns of nozzles for magenta (M) and cyan (C) inks, one for one, they are arranged so that in terms of the direction indicated by the arrow mark D, the lengthwise end of the ink passage wall, the width of which is L1 (L1<L2), is on the upstream side of the lengthwise end of the corresponding (opposing across ink delivery channel) ink passage, which is L2 (L2>L1) in width. Also in the case of the two columns of nozzles for yellow (Y) and black (Bk) nozzles, one for one, they are arranged so that in terms of the direction indicated by the arrow mark D, that is, the direction in which the protection tape 14 is to be peeled, the lengthwise end of the ink passage wall, the width of which is L3, is on the upstream side of the lengthwise end of the corresponding (opposing across ink delivery channel) ink passage, which is L4 (L4>L3) in width.

That is, the head shown in FIG. 6(*a*) is structured so that in terms of the direction indicated by the arrow mark D, that is, the direction in which the protection tape 14 is to be peeled, the columns of nozzles of each of the four head elements are positioned so that the lengthwise end of the ink passage wall, which is narrower in width, is on the upstream side of the lengthwise end of the corresponding (opposing across ink delivery channel) ink passage, which is wider.

Further, regarding the relationship among the columns of nozzles, in terms of the size of area of contact (bonding) between the ink passage wall and substrate, the ink jet head shown in FIG. 6(*a*) is structured so that in the case of the column of nozzles for magenta (M) ink and the column of nozzles for cyan (C) ink, the area S1 of wall contact is on the upstream side of the area S2 of wall contact (S1<S2), in terms of the direction indicated by the arrow mark D, and also, so that in the case of the column of nozzles for yellow (Y) ink and the column of nozzles for black (Bk) ink, the area S3 of wall contact is on the upstream side of the area S4 of wall contact (S3<S4), in terms of the direction indicated by the arrow mark D. That is, the ink jet head shown in FIG. 6(*a*) is structured so that, in terms of the direction indicated by the arrow mark D, that is, the direction in which the protection seal is to be peeled, the columns of ink ejection nozzles in each head element are arranged so that the area of contact between the ink passage wall and substrate, on the upstream side, is larger than the area of contact between the ink passage wall and substrate, on the downstream side.

Also in the case of an ink jet head made up of a combination of multiple head elements different in structure, it is structured so that the columns of ink ejection nozzles in each head element are arranged so that in terms of the direction in which the protection tape (seal tape) is to be peeled, each of the ink passage walls which are narrower in end width, is on the upstream side of the corresponding ink passage wall which is wider in end width. With the employment of this structural arrangement, and the bonding of the protection tape as described above, the protection tape is peeled from the side where the ink jet head is less tolerant to the stress which is caused as the seal tape is peeled, toward the side where the ink jet head is more tolerant to the stress which is caused by the peeling of the seal tape.

The protection tape 14 is bonded so that its lengthwise direction becomes perpendicular to the columns of ink ejection nozzles, and also, so that its pull-tab portion extends upstream (in terms of peeling direction of protection tape) from the edge of the ink ejection nozzle plate, which is on the upstream side, that is, the side on which the area of contact between the portion of the ink passage wall, which is next to the ink delivery channel, and the substrate, is smaller. Incidentally, the protection tape may be bonded in a manner to allow the opposite end of the protection tape from the pull-tab to extend downstream beyond the edge of the ink ejection nozzle plate. However, when the protection tape is bonded in this manner, the distance by which the protection tape extends downstream from the opposite edge of the ink ejection nozzle plate from the pull-tab must be smaller than the distance by which the protection tape extends upstream from the side where the pull-tab is present.

In a case where the protection tape is bonded so that it extends beyond the ink jet head, on the side on which the area of wall contact is greater, if the extending portion of the protection tape is long, this portion might hang up on the ink jet head manufacturing apparatuses, which might cause the protection tape to peel. Therefore, it is desired that the protection tape is bonded so that the protection tape extends as little as possible from the opposite side of the ink jet head from the pull-tab. Further, it is desired that the protection tape is bonded so that its falls between the body of second sealant 4, which is at one end of the ink ejection surface, and the body of second sealant 4, which is on the other end of the ink ejection surface, in terms of the direction parallel to the columns of ink ejection nozzles.

However, it is sometimes necessary to reduce in size the substrate in order to reduce an ink jet head in substrate cost. One of the methods for reducing the substrate in size is to place the outermost columns of ink ejection nozzles very close to the edges of the ink ejection nozzle plate. If the outermost columns of ink ejection nozzles are placed very close to the edges of the ink ejection nozzle plate, it is rather difficult to accurately position the end of the protection tape between the outermost columns of ink ejection nozzles and the edge of the ink ejection nozzle plate. Thus, in order to ensure that the protection tape is accurately positioned, the manufacturing step for bonding the protection tape must be improved in terms of protection tape alignment accuracy. This sometimes adds to the manufacturing cost of an ink jet head. Therefore, when it is necessary to reduce in size the substrate for the abovementioned reason or the like, it is better to employ a protection tape bonding method which allows the protection tape to extend downstream beyond the opposite edge of the ink jet head from the pull-tab. Incidentally, the portion of the protection tape extending beyond the opposite edge of the ink jet head from the pull-tab may be bonded to a component (or portion of ink jet head) other than the ink ejection nozzle plate.

In this embodiment, the protection tape was bonded to the head so that the pull-tab portion of the protection tape would be on the side where the wall contact area was smaller. When the protection tape 14 was peeled from the pull-tab side, the ink passage walls 19 did not separate from the substrate 5. However, when the protection tape was bonded to the head so that its pull-tab portion was on the side where the wall contact area was larger, a problem occurred. That is, in some cases, as the protection tape 14 was peeled from the pull-tab side, some ink passage walls separated from the substrate, and/or cracks appeared in the adjacencies of the openings of the ink ejection nozzles, which prevented ink from being jetted in the preset direction.

That is, if the protection tape is peeled in the direction different (opposite) from the direction in which the protection tape is to be peeled in this embodiment, some ink passage walls 19 separate from the substrate 5, which affects the ink ejection from the liquid jetting head, in some cases. This is why an ink jet head is to be structured as it is in the first embodiment, and also, the protection tape is to be bonded as it is in the first embodiment, in order to ensure that the protection tape is not peeled in the wrong direction.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 105901/2007 and 095124/2008 filed Apr. 13, 2007 and Apr. 1, 2008, which are hereby incorporated by reference herein.

What is claimed is:

1. An ink jet head comprising:

an elongated ink supply port extending in a longitudinal direction;

a plurality of head groups, each of which comprises at least three head elements, arranged in a transverse direction crossing with the longitudinal direction, each of said head elements comprising a part of said ink supply port, a first array of ink ejection outlets for ejecting ink, ink passages for fluid communication between said ink ejection outlets of the first array and the part of said ink supply port, a second array ink ejection outlets for ejecting ink, ink passages for fluid communication between said ink ejection outlets of the second array and the part of said ink supply port, a third array of ink ejection outlets for ejecting ink, ink passages for fluid communication between said ink ejection outlets of the third array and the part of said ink supply port, and partition walls between adjacent ink passages, and a sealing tape for protecting said ejection outlets, said sealing tape being peelable in a direction from said second or third array toward said first array in each of said head elements, wherein the first array of said ink ejection outlets is disposed along one lateral side of the part of said ink supply port, and the second and third arrays of said ink ejection outlets are disposed along the other lateral side of said ink supply port, and wherein widths L2, measured in the longitudinal direction, of said partition walls for the first array of said ink ejection outlets are greater than widths L1, measured in the longitudinal direction, of said partition walls for the second and third arrays of said ink ejection outlets.

2. An ink jet head according to claim 1, wherein a diameter of said ejection outlets in the first array is larger than a diameter of said ejection outlets in the second array, which is larger than a diameter of said ejection outlets in the third array.

3. An ink jet head according to claim 1, wherein numbers of ejection outlets per unit length in the longitudinal direction are the same in the first, second and third arrays.

4. An ink jet head according to claim 1, wherein said partition walls are connected with a substrate, and wherein an area S1 of the connection therebetween in a range from an end of one of said partition walls adjacent to a lateral end of said ink supply port to one half the distance between the end and an end of an ink ejecting energy generating element adjacent to the lateral end of said ink supply port, for the second and third arrays, is smaller than such an area S2 for the first arrays.

5. An ink jet head comprising:

an elongated ink supply port extending in a longitudinal direction;

a plurality of head groups, each of which comprises at least three head elements, arranged in a transverse direction crossing with the longitudinal direction, each of said head elements comprising a part of said ink supply port, a first array of ink ejection outlets for ejecting ink, ink passages for fluid communication between said ink ejection outlets of the first array and the part of said ink supply port, a second array ink ejection outlets for ejecting ink, ink passages for fluid communication between said ink ejection outlets of the second array and the part of said ink supply port, a third array of ink ejection outlets for ejecting ink, ink passages for fluid communication between said ink ejection outlets of the third array and the part of said ink supply port, a fourth array of ink ejection outlets for ejecting ink, ink passages for fluid communication between said ink ejection outlets of the fourth array and the part of said ink supply port, a fifth array of ink ejection outlets for ejecting ink, ink passages for fluid communication between said ink ejection outlets of the fifth array and the part of said ink supply port, and partition walls between adjacent ink passages, and a sealing tape for protecting said ejection outlets, said sealing tape being peelable in a direction from said second, third or fifth array toward said first or fourth array in each of said head elements, wherein the first and fourth arrays of said ink ejection outlets are disposed along one lateral side of the part of said ink supply port, and the second, third and fifth arrays of said ink ejection outlets are disposed along the other lateral side of said ink supply port, wherein widths L2, measured in the longitudinal direction, of said partition walls for the first array of said ink ejection outlets are greater than widths L1, measured in the longitudinal direction, of said partition walls for the second and third arrays of the said ink ejection outlets, and wherein widths L3, measured in the longitudinal direction, of said partition walls for the fourth array of said ink ejection outlets are greater than widths L4, measured in the longitudinal direction, of said partition walls for the fifth array of said ink ejection outlets.

6. An ink jet head according to claim 5, wherein a diameter of said ejection outlets in the first array is larger than a diameter of said ejection outlets in the second array, which is larger than a diameter of said ejection outlets in the third array, and wherein a diameter of said ejection outlets in the fourth array is larger than a diameter of said ejection outlets in the fifth array.

7. An ink jet head according to claim 5, wherein numbers of ejection outlets per unit length in the longitudinal direction are the same in the first, second, third, fourth and fifth arrays.

8. An ink jet head according to claim 5, wherein said partition walls are connected with a substrate, and wherein an area S1 of the connection therebetween in a range from an end of one of said partition walls adjacent to a lateral end of said ink supply port to one half the distance between the end and an end of an ink ejecting energy generating element adjacent to the lateral end of said ink supply port, for the second and third arrays, is smaller than such an area S2 for the first array, and wherein such an area S3 for the fourth array is smaller than such an area S4 for the fifth array.

* * * * *